US009595151B2

(12) United States Patent
Guindulain Busto

(10) Patent No.: US 9,595,151 B2
(45) Date of Patent: Mar. 14, 2017

(54) COIN CONTAINER FOR AUTOMATIC MACHINES

(71) Applicant: JOFEMAR, S.A., Peralta (Navarra) (ES)

(72) Inventor: Felix Guindulain Busto, Peralta (ES)

(73) Assignee: JOFEMAR, S.A., Navarra (ES)

( * ) Notice: Subject to any disclaimer, the term of this patent is extended or adjusted under 35 U.S.C. 154(b) by 0 days.

(21) Appl. No.: 14/894,167

(22) PCT Filed: May 27, 2014

(86) PCT No.: PCT/ES2014/070430

§ 371 (c)(1),
(2) Date: Nov. 25, 2015

(87) PCT Pub. No.: WO2014/191599

PCT Pub. Date: Dec. 4, 2014

(65) Prior Publication Data

US 2016/0104336 A1 Apr. 14, 2016

(30) Foreign Application Priority Data

May 27, 2013 (ES) ..... 201330771

(51) Int. Cl.
*G07D 1/00* (2006.01)
*G07D 3/14* (2006.01)

(52) U.S. Cl.
CPC ..... *G07D 3/14* (2013.01); *G07D 1/00* (2013.01)

(58) Field of Classification Search
CPC .. G07D 1/00; G07D 3/14; G07D 3/16; G07D 9/06; G07D 2201/00
See application file for complete search history.

(56) References Cited

U.S. PATENT DOCUMENTS 3,366,127 A 1/1968 Breitenstein et al.
8,262,441 B2 * 9/2012 Chang ..... G07D 1/00 453/18

FOREIGN PATENT DOCUMENTS

EP 0015724 9/1980
EP 0310452 4/1989
EP 0450927 10/1991
(Continued)

OTHER PUBLICATIONS

PCT Search Report and Written Opinion mailed Oct. 6, 2014, PCT/ES2014/070430, 9 pages.

*Primary Examiner* — Mark Beauchaine
(74) *Attorney, Agent, or Firm* — Blakely Sokoloff Taylor & Zafman LLP

(57) ABSTRACT

It comprises reception means for enabling coins to access the coin mechanism; identification means for determining the acceptability, type and value of the accessing coins; a coin storage compartment for selectively housing and delivering the coins destined for being refunded to a user, where the coin storage compartment comprises a plurality of tubes, according to rows and columns; extraction means for selectively extracting the coins from the tubes; and raising means for selectively raising any of the tubes during extraction of the coins, in order to momentarily provide a space for each coin to exit without colliding with the adjacent tubes. It allows greater optimisation of the use of the space destined for the coin mechanism, particularly the coin storage compartment.

20 Claims, 5 Drawing Sheets

(56) References Cited

FOREIGN PATENT DOCUMENTS

| | | |
|---|---|---|
| EP | 1067486 | 1/2001 |
| WO | WO-9858355 | 12/1998 |

* cited by examiner

COIN CONTAINER FOR AUTOMATIC MACHINES

CROSS-REFERENCE TO RELATED APPLICATIONS

The present patent application is a national phase application of International Application No. PCT/ES2014/070430, filed May 27, 2014, which claims priority to Spanish Application No. P201330771, filed May 27, 2013, the disclosures of which are incorporated herein by reference.

OBJECT OF THE INVENTION

This invention falls under the technical field of coin-operated automatic machines.

More specifically, the object of the invention is a system dedicated to performing, in a controlled manner, the acceptance, storage and refund of the coins used by the users as payment in said automatic machines. Said system is known in the field of automatic machines as "coin mechanism".

BACKGROUND OF THE INVENTION

Coin-operated automatic machines generally include a system, called coin mechanism, configured to manage payment with coins by means of the acceptance, storage and refunding of said coins. Coin mechanisms may be incorporated, for example, to automatic playing machines (so-called slot machines), coin-operated Internet-connected machines and, in general, any type of vending machines, such as automatic dispensers of beverages, tobacco, transport tickets, hygiene products, etc.

Coin mechanisms generally comprise reception means, for example, coin reception slots where through the user deposits the coins, allowing the coins to access the coin mechanism. Also, coin mechanisms comprise identifying means for identifying the acceptability of the coins (and, where applicable, their value) or non-acceptability of the coins (in which case the coins are refunded). Likewise, the coin mechanisms incorporate a coin storage compartment for housing, in a discriminated manner, the accepted coins destined for being refunded as change or a prize. Other coins, destined for being stored as cash collection, are guided towards a cash box disposed inside the automatic machine.

The coins destined for being refunded as change or a prize are guided towards the coin storage compartment disposed in the interior of the automatic machine, which comprises cylindrical deposits called tubes, where the coins are accumulated in a pile waiting to be refunded. The tubes comprise ejection slots on the lower part in order to allow access to a trigger incorporated to ejection means destined to extract the coins from the tubes.

A great diversity of coin mechanisms such as that generally described are known in the current state of the art, configured to be integrated in automatic machines of this kind. These include, inter alia, systems having three-tube systems, four-tube systems, five-tube systems, such as the Jofemar J2000 model or the Mei Cash-Flow model, and six-tube systems, such as the Crane Currenza model.

Automatic machines wherein coin mechanisms are installed have a limited space for housing said mechanism, which is predetermined in a standard manner, in such a manner that the maximum dimensions of the coin mechanisms are imposed by said standardised configuration of the automatic machines.

Most of the coin mechanisms have the problem of not being able to store sufficient coins allowing full autonomy, due to which, once the coins of a certain value are exhausted, the machine obliges the user to introduce the exact amount or inhibits the sale, leaving the machine out of order.

In order to solve this problem, many machines require the incorporation of external coin dispensers, which are manually replenished and whereover there is no accounting control. In other cases, the machines are obliged to incorporate other coin systems, such as revolving returners, for example that of Hopper, which have much greater autonomy but which, in turn, occupy a space five times greater than traditional coin systems, where there is often not enough space inside the automatic machine.

At the same time, another of the most usual problems is the coexistence, in the same country, of old and new coins of the same value but different physical shape, in which case, due to the fact that there is an insufficient number of tubes, only a few of them can be stored in said tubes, while the others are accepted but deviated directly to the coin storage compartment, thereby diminishing the autonomy of the system, as the coin storage compartment is fed by the coins that the users of the machines introduce to obtain a product or service.

The same problem occurs in those countries where coins of other countries are accepted in addition to the local currency, such as for example, England, where both pounds sterling and euros are accepted; Switzerland, where francs and euros are accepted; or Cuba, where pesos and US dollars are accepted, etc.

Another very common problem with the coin systems known in the state of the art is that they are generally highly accessible, in such a manner that they can be fraudulently manipulated without leaving any trace of said manipulation. Therefore, said coin systems imply a risk of theft of coins by the operators of said machines, which are not usually the owners themselves.

All of the aforementioned problems can be summarised in the need to provide a coin mechanism for automatic machines that not accept payment with coins, which allows storage in the coin storage compartment of the maximum possible number of types, in order to increase the autonomy and versatility of the automatic machine, within the aforementioned space constraints.

DESCRIPTION OF THE INVENTION

The invention solves the technical problem raised by means of a coin mechanism for vending machines, as described below.

The coin mechanism of the present invention comprises, as known in the state of the art:

- reception means, configured to allow coins to access the coin mechanism;
- identification means, to capture relevant information on the coins which is relevant to determine whether the coins are valid or not and, if valid, to identify the type and value of said coins; and
- a coin storage compartment, configured to house and deliver the coins that are selectively destined to be refunded to a user, whether as change or as a prize, where the coin storage comprises a plurality of tubes where each of the tubes is destined for simultaneously housing coins of a single type.

The coin mechanism of the invention is characterised in that it allows, in accordance with requirements advocated by the standardised configuration of the vending machines, such as for example, the space constraints imposed on the coin mechanisms, and also, inter alia, the definition of anchorage points of the coin mechanism, areas where the coins enter and exit the cash box or the coin storage compartment, the incorporation of a greater number of tubes than the devices described in the state of the art. In particular, always in accordance with the dimensions of the coins, the coin mechanism of the invention may manage a coin storage compartment having at least eight different tubes. Said effect is achieved by combining a series of structural and functional characteristics explained below.

In particular, the tubes are distributed in accordance with a very compact matrix configuration of rows and columns wherein the tubes are disposed as closely as possible, nearly in contact with each other, and the coin mechanism also comprises extraction means destined for extracting the coins from the lower part of the tube. The extraction means preferably comprise an extraction carriage disposed movably below the tubes, in order for said extraction means to selectively extract the coins from the interior of the tube during movement of the extraction carriage.

The coin mechanism of the invention is characterised in that it also incorporates, advantageously, raising means for selectively raising any of the tubes during extraction of the coins by the extraction means, in such a manner as to momentarily provide a space for the coin to exit without colliding with the adjacent tubes. Therefore, although the tubes are so close to each other that the coins cannot exit, on momentarily raising any of the tubes a space is created that is occupied by the extracted coin.

Additionally, the invention may include a control unit destined for controlling various aspects of the operation of the coin mechanism, such as accounting, access to the coins or event recording, inter alia. The control unit may also be programmed in order to determine, based on the records of the incoming coins, both those guided towards the cash box and those guided towards the coin storage compartment, that one of the tubes is prioritarily emptied and destined for housing a different type of coins.

As previously explained, the coin mechanism of the invention implies a significant increase in capacity and autonomy with respect to the 3, 4, 5 and 6-tube mechanisms described in the state of the art. The capacity to manage coins of at least eight different values and types endows it with great flexibility, facilitating operation in countries where different coins coexist, and also facilitating the assignment of more than one tube to a certain value in order to avoid having to incorporate external storage systems.

DESCRIPTION OF THE DRAWINGS

In order to complement the description being made and with the object of helping to better understand the characteristics of the invention, in accordance with a preferred embodiment thereof, said description is accompanied, as an integral part thereof, by a set of drawings where, in an illustrative and non-limiting manner, the following has been represented.

PREFERRED EMBODIMENT OF THE INVENTION

Following is a detailed description, in light of the aforementioned FIGS. 1 to 7, of a preferred embodiment of the invention.

Figure 1:
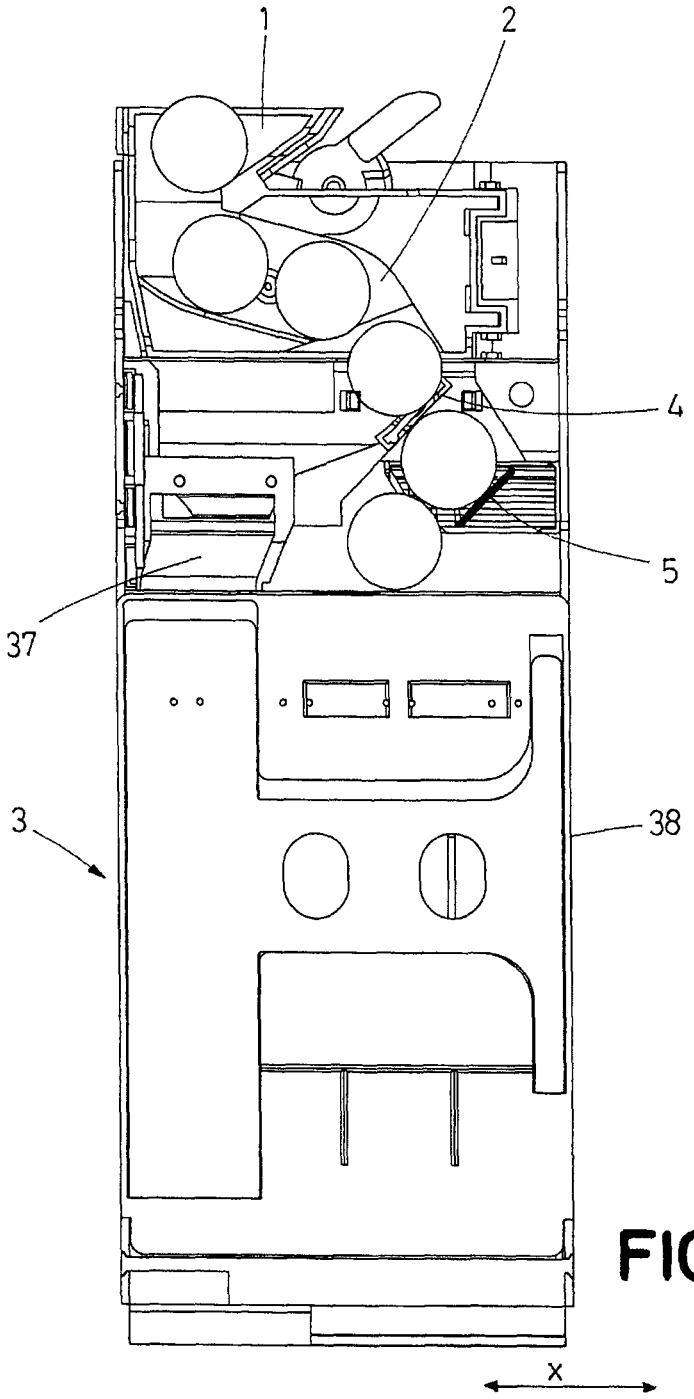
FIG. 1 shows a rear view of a coin mechanism in accordance with the invention, where the rear upper part is shown open in order to observe the interior.

The coin mechanism for automatic machines described below, in accordance with a preferred embodiment of the present invention, comprises, as shown in FIG. 1, reception means which grant the coins access to the coin mechanism. The reception means may be any of the universally known types, for example, they may comprise a reception slot (1).

Continuing with FIG. 1, the coin mechanism also incorporates a receiving channel (2), where the coin accesses from the reception means. Throughout the receiving channel (2) there are various identification sensors (not represented in the figures) destined for extracting the necessary coin data for identifying said coin and, consequently, validating or rejecting it.

At the end of the receiving channel (2) there are guiding means for guiding the coin: towards a rejection channel (37) if the coin is considered invalid; towards a cash box (not shown) if the coin is considered valid and therefore destined to cash collection; or towards a storage box (3) comprising tubes (39, 40, 43, 44), in the case that the coin is recognised as valid and is destined to be refunded to the user of the automatic machine, for example as change or a prize.

In accordance with a preferred embodiment, the guiding means comprise a mobile component, called first gate (4) that is linked to a first electromagnetic coil (not shown) which may adopt two states, depending on whether it is excited or idle. In a first state of the first coil, the first gate (4) occupies a first position to allow the passage of the coin towards the rejection channel (37). In a second state of the first coil, the first gate (4) occupies a second position which allows the passage of the coin, adequately identified, towards a second gate (5) associated, similarly to the case described for the first gate (4), with a second electromagnetic coil (not shown), if the result of the identification is that the coin is valid and its type and/or value have been correctly identified.

The second gate (5) is also mobile and is associated with the second coil (not shown). In a first state of the second coil, the second gate (5) occupies a first position which allows access of the coin towards the cash box. In a second state of the second coil, the second gate (5) occupies a second position which allows the passage of the coin towards a classifier, wherefrom the coin will access the coin storage compartment (3), in which the coins waiting to be refunded to the user, by way of change or a prize, are stored, according to the type of automatic machine and the operating circumstances.

The assembly formed by the reception means, the receiving channel (2), the identification sensors and guiding means may adopt any configuration known in the state of the art, particularly those described in applications P9001938, P9003304, P9602334, P9701226, P9901904, P9200001978 and U200601134, owned by the applicant.

The coin storage compartment (3) comprises a series of cylindrical deposits (see FIG. 6), called tubes (39, 40, 43, 44), each of which is destined for simultaneously housing coins of a single type. If it is convenient for the operation of the machine, more than one tube (39, 40, 43, 44) may be destined to coins of the same type. The tubes (39, 40, 43, 44) are disposed in a matrix configuration with a number N, greater than one, of rows (F1, F2) that extend in the direction of width (X) of the coin mechanism, and a number M, greater than two, of columns (C1, C2, C3, C4) that extend in the direction of depth (Y) of the coin mechanism. According to a preferred embodiment, which shall be explained in greater detail in this preferred description, the coin storage compartment (3) comprises eight tubes (39, 40, 43, 44) forming four columns (C1, C2, C3, C4) and two rows (F1, F2).

The coin storage compartment (3) shall preferably be capable of adapting to changes in the thicknesses and/or diameter of the coins contained in the tubes (39, 40, 43, 44). Therefore, the tubes (39, 40, 43, 44) may have different tube diameters. Likewise, the tubes (39, 40, 43 44) are preferably interchangeable.

A corresponding extraction bushing (6), adequate to the dimensions of the coin to which the tube is destined (39, 40, 43, 44), is fixed to the lower part of each tube (39, 40, 43, 44) in order to bear the weight of the coins. Each extraction bushing (6) comprises an ejection slot (7) to allow the extraction of the coins, preferably one by one, as will be explained later in the text.

The tubes (39, 40, 43, 44) have tube diameters which are at least slightly superior to the diameter of the corresponding coin. The number of tubes (39, 40, 43, 44) that can be disposed in a predefined space depends on the respective tube diameters. In accordance with illustrative examples, wherein the predefined space corresponds to that defined in a standard manner in the vending machines, eight tubes (39, 40, 43, 44) may be disposed, in accordance with two 29 mm diameter tubes (39, 40, 43, 44) and six 27 mm diameter tubes (39, 40, 43, 44); also, seven tubes (39, 40, 43, 44), in accordance with one 34 mm tube (39, 40, 43, 44), two 29 mm diameter tubes (39, 40, 43, 44) and four 27 mm diameter tubes (39, 40, 43, 44) may also be disposed. The established limitations relate to maximum measurements, as the limit towards minimum measurements is determined by the diameter of the coins.

A device called "classifier" is disposed in an intermediate position between the identification sensors and the coin storage compartment (3). The mission of the classifier is to collect the coins once they have been accepted and identified, and transfer them to the corresponding tube (39, 40, 43, 44). To this end, the classifier provides the coin, once identified, with a combined movement in the direction of the width (X) of the coin mechanism and in the direction of the depth (Y) of the coin mechanism, to leave the coin ready to fall into the corresponding tube (39, 40, 43, 44).

Figure 2:
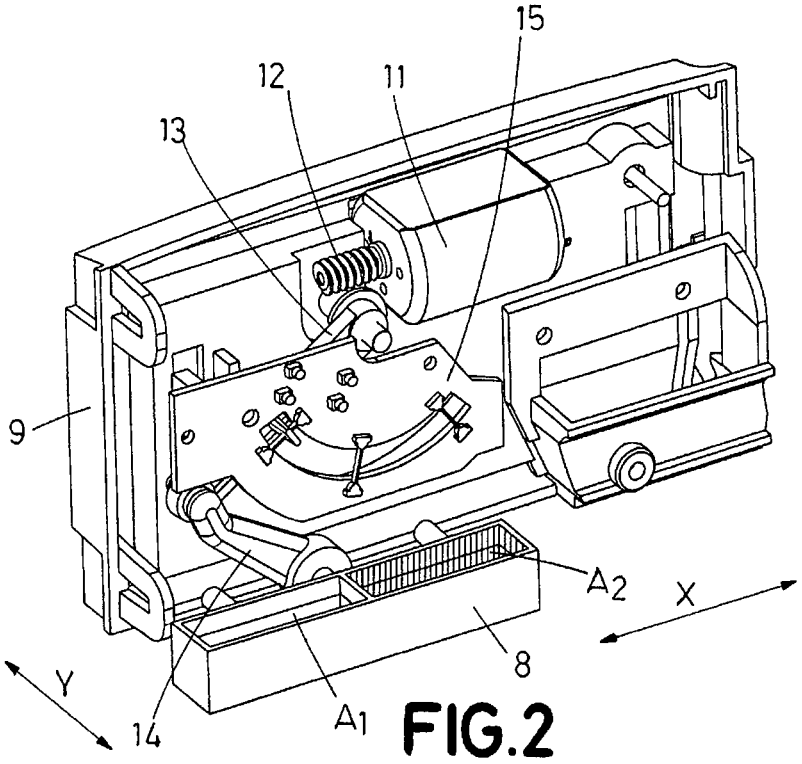
FIG. 2 shows a first detailed view of the support and housings.
Figure 3:
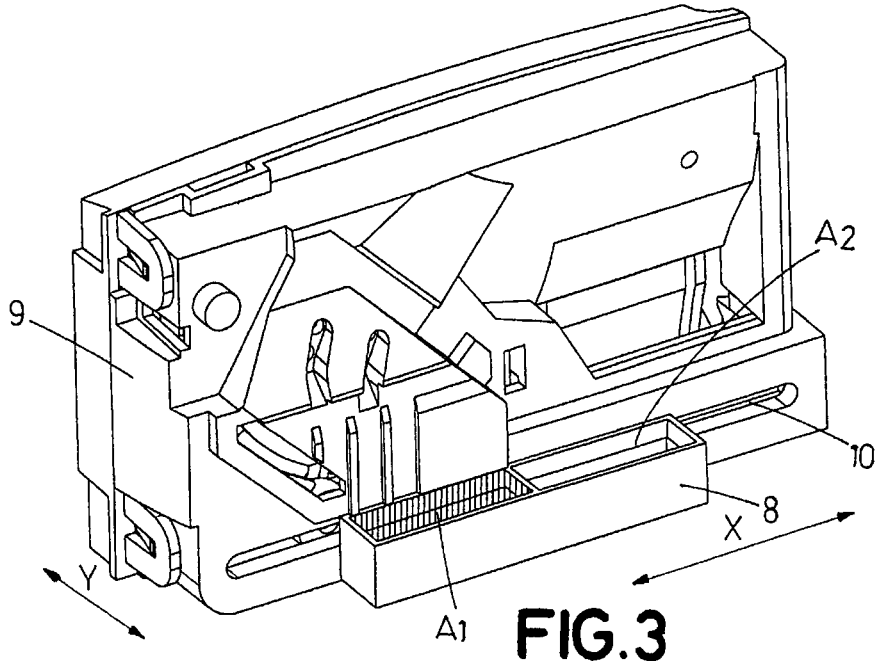
FIG. 3 shows a second detailed view of the support and housings.

More specifically, the classifier comprises movement means configured to provide the identified coins with a combined movement both in the direction of the width (8) and in the direction of depth (Y) to leave said coins on the corresponding tube (39, 40, 43, 44). In accordance with one example, as shown in FIGS. 2 and 3, the movement means comprise, in turn, a support (8), as shown in FIGS. 2 and 3, having at least one housing (A1, A2), to receive the identified coins, where the support (8) is movable, by means of first actuation means, in the direction of width (X), to allow the housings (A1, A2) to occupy a plurality of stopping positions which allow the coin to remain respectively located on each of the columns (C1, C2, C3, C4). Preferably, of particular interest in the case of having four columns (C1, C2, C3, C4), the support (8) comprises two housings (A1, A2). Likewise, also preferably, the movement means also incorporate a support guide (10) wherealong the support (8) is movable in the direction of width (X).

Even more preferably, the first actuation means comprise: a support motor (11), for causing movement of the support (8); an endless pinion (12) that engages with the support motor (11); a first connecting rod (13) that engages with the endless pinion (12); and a second connecting rod (13), preferably shorter than the first connecting rod (13), and which is rotatingly articulated with said first connecting rod (13) and with the support (8).

The first actuation means may additionally incorporate a classifier card (15) having a plurality of photocell pairs (not represented), where each pair comprises: an emitting photocell for emitting a beam corresponding to said pair and a receiving photocell for receiving the corresponding beam. Additionally, a protuberance (not shown) made in the first connecting rod (13) to cut the photocell beams is incorporated, where said beams correspond to the different stopping positions of the support (8), to cause the support (8) to stop in a predetermined stopping position. In the preferred case of four columns (C1 C2, C3, C4) and two rows (F1, F2), and two housings (A1, A2) in the support (8), three stopping positions are defined.

Figure 4:
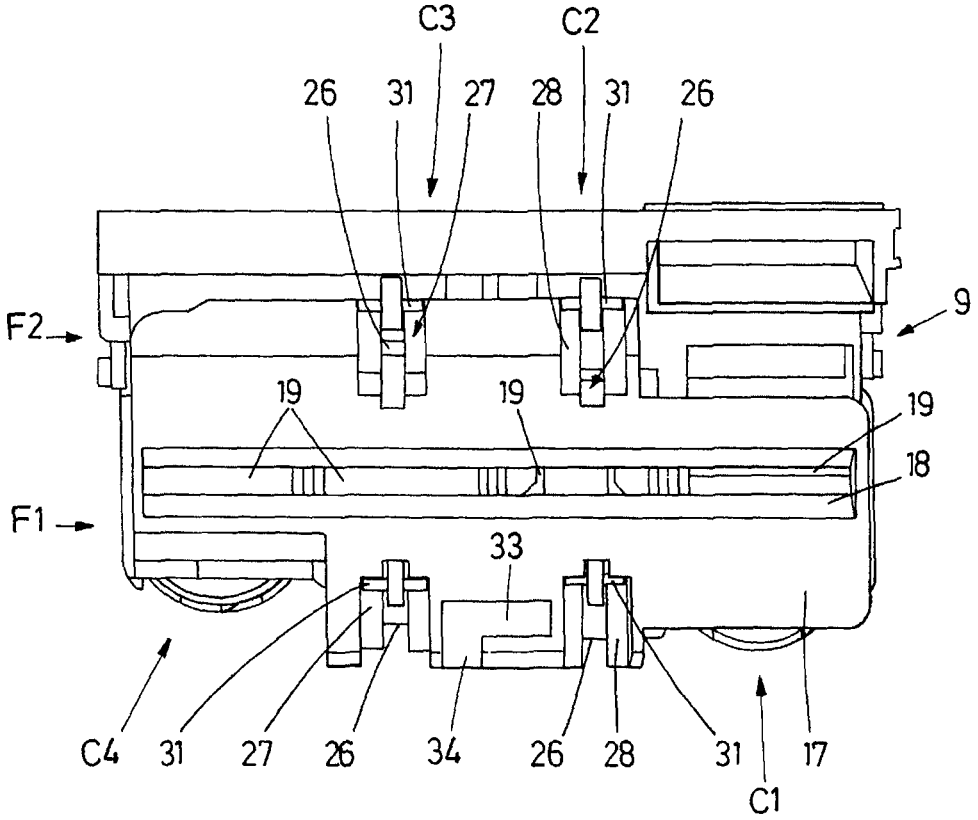
FIG. 4 shows a top view of the classifier, where the classification carriage is moved in the direction of depth (Y), from a central reference position, displayed in a position in which the selection slot is located above one of the tube rows.

The movement means may additionally comprise (see FIG. 6), a guiding part (46) linked to the upper part of the tubes (39, 40, 43, 44), and a classification carriage (17), as shown in FIG. 4, movable with respect to the guiding part (46) in the direction of depth (Y) and having a selection slot (18) made in the direction of width (X). In its movement in the direction of depth (Y), the classification carriage (17) may occupy a plurality of depth positions which allow the selection slot (18) to be located respectively above one of the rows (F1, F2) or in an intermediate position between each pair of adjacent rows (F1, F2). For example, in the case of two rows (F1 F2), the classification carriage (17) occupies, by default, a central depth position located between the first row (F1) and the second row (F2) and, once the support (8) has moved in the direction of width (X) towards a predetermined stopping position, the classification carriage (17) moves from the central position towards a front depth position, corresponding to the first row (F1), or towards a rear depth position, corresponding to the second row (F2), as required. Preferably, the classification carriage (17) is a flat part.

Further, the movement means additionally comprise second actuation means for actuating the abovementioned movement of the classification carriage (17) with respect to the guiding part (46) in the direction of depth (Y), defining the depth positions for the selection slot (18) on the corresponding rows (F1, F2).

The housings (A1, A2) do not have a bottom, i.e. they comprise an open upper part, for receiving the coin, and a lower part, also open, and which is connected to the selection slot (18) of the classification carriage (17), enabling the coin to partially project from the lower part for associating the coin simultaneously with the support (8) and the classification carriage (17) during the movements of the support (8) and of the classification carriage (17); where the lower part is in contact with the selection slot (18), so that one part of the coin is located in the housings (A1, A2) and another part projects from the housings (A1, A2) from below and is inserted in the selection slot (18), in such a manner that during the respective movements of the support (8) and the classification carriage (17), the coin will always be linked with both the support (8) and with the classification carriage (17).

The guiding part (46) comprises a delivery slot (19) for each tube (39, 40, 43, 44), in such a manner that the stopping position and depth position generated by the movements of the support (8) and the movement carriage (17) selectively determine a delivery position for the delivery slot (19) on the corresponding tube (39, 40, 43, 44).

Returning to the aforementioned preferred example of the two rows (F1, F2) of four columns (C1, C2, C3, C4) and a support (8) having two housings (A1, A2), the support (8) may collect a coin in a first outermost housing (A1) with respect to a first end (9) in the direction of width (X), or in a second housing (A2). Likewise, the support (8) is movable to occupy three stopping positions: a first outermost stopping position, consequent with the first end (9); a second stopping position, adjacent to the first stopping position, in a direction opposite the first end (9) in the direction of width (X); and a third stopping position, adjacent to the second stopping position and, therefore, opposite the first stopping position.

As a result of choosing a housing (A1, A2) for the coin and a stopping position for the support (8), the coin will be housed in the selection slot (18) in one of four possible discharge positions: an extreme first discharge position, disposed further towards the end, consequent with the first end (9); a second discharge position adjacent to the first discharge position in a direction opposite the direction of the width (X), a third discharge position, adjacent to the second discharge position, and a fourth discharge position, adjacent to the third discharge position and, therefore, opposite to the first discharge position.

According to a default configuration, the support (8) occupies the second stopping position, enabling a coin housed in the first housing (A1) to occupy the second discharge position or, alternatively, enabling a coin housed in the second housing (A2) to occupy the third discharge position. If, from the default configuration, the support (8) moves towards the first stopping position, a coin housed in the first housing (A1) would occupy the first discharge position, while a coin housed in the second housing (A2) would occupy the second discharge position. On the contrary, if, from the default configuration, the support (8) moves towards the third stopping position, a coin housed in the first housing (A1) would occupy the third discharge position, while a coin housed in the second housing (A2) would occupy the fourth discharge position.

Figure 5:
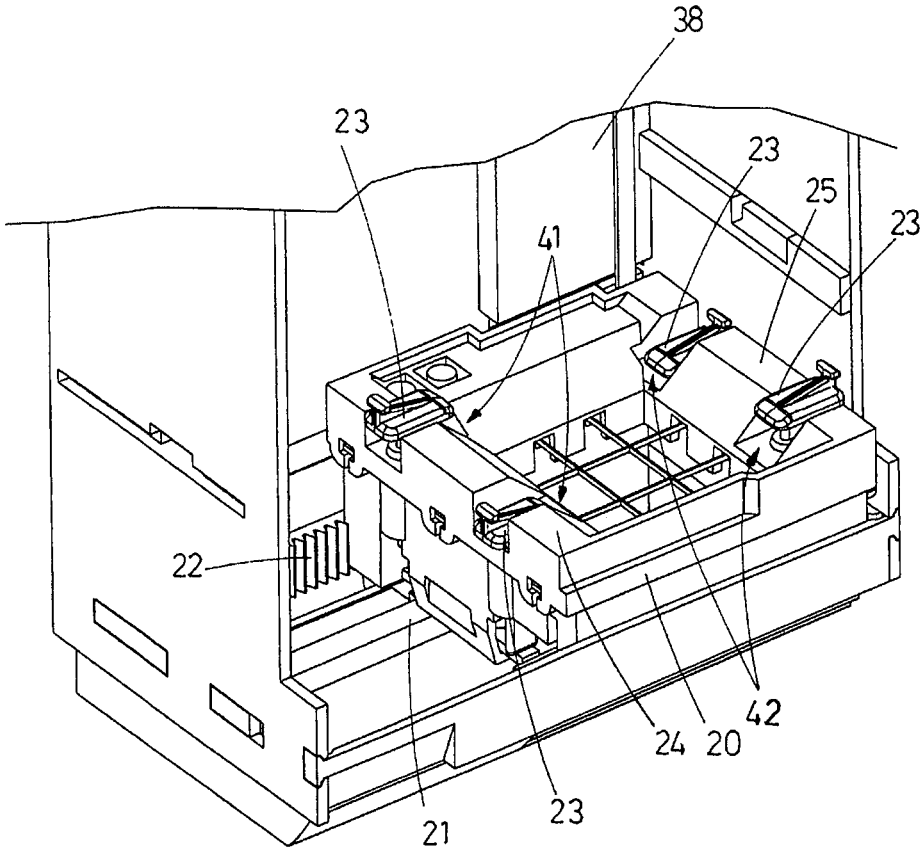
FIG. 5 shows a view of the extraction means.

FIG. 5 shows how, in order to cause extraction of the coins from the tubes (39, 40, 43, 44), the coin mechanism incorporates extraction means which, in addition to the extraction bushings (6) and the aforementioned ejection slots (7) comprise, in accordance with an example of the invention, an extraction carriage (20) located under the tubes (39, 40, 43, 44), and transport means for transporting the extraction carriage (20) in the direction of width (X), defining different extraction positions for the extraction carriage (20). The extraction means also comprise guiding means (21) whereover the extraction carriage (20) is movable. The extraction means also comprise at least one ejector (41, 42) linked to the extraction carriage (20) and movable in a vertical direction between a retracted position and a projecting position, where the ejector (41, 42) additionally comprises a trigger (23) in correspondence with the ejection slots (7), so that, in order to extract a coin from a certain tube (39, 40, 43, 44), the ejector (41, 42) is moved so as to protrude and the extraction carriage (20) is moved from an extraction position to another adjacent extraction position, while the trigger (23) traverses the corresponding ejection slot (7), thereby expelling a coin.

The tubes (39, 40, 43, 44) have the same length and are, preferably, initially disposed with the minimum separation therebetween, in order to take maximum advantage of the available space. Likewise, their upper and lower ends are disposed in identical, upper and lower horizontal planes, respectively. In these conditions, as coin extraction is preferably towards the interior, i.e. the trigger (23) moves towards the furthest end in the direction of width (X), the aforementioned position of the tubes (39, 40, 43, 44) could cause the ejected coins to collide with one of the adjacent tubes (39, 40, 43, 44), particularly with the extraction bushings (6).

In order to overcome this drawback, at least one of the tubes (39, 40, 43, 44) is a movable tube (40, 43). Likewise, the coin mechanism additionally comprises raising means destined for selectively raising (and/or lowering, as will be explained later in the text, in relation to a preferred embodiment) some of the movable tubes (39, 40, 43, 44) in synchronisation with the movement of the classification carriage (17), so that the coins may be ejected without colliding with the adjacent tubes (39, 40, 43, 44).

Preferably, the extraction carriage (20) has a configuration similar to that of an internally emptied cube. For illustrative purposes, according to the aforementioned example of a storage box (3) with two rows (F1, F2) of four columns (C1, C2, C3, C4) and a support (8) with two housings (A1, A2), the extraction carriage (20) comprises, in the direction of width (X), an external side section (24) corresponding to the first end (9), and an internal side section (25) opposite the external side section (24). A pair of ejectors (41, 42) is disposed on each of the side sections (24, 25). By way of example, the ejectors (41, 42) are connected to corresponding ejection coils (not shown) in order to be raised and lowered, allowing the triggers (23) to traverse the ejection slots (7) and extract the coins.

Preferably, the extraction carriage (20) is solidarily joined to a motor casing (not represented), which is connected to a gear (not shown) ending in a pinion (not shown) engaging a rack (22) made in the coin mechanism frame (38), which is solidarily joined to the guiding means (21), so that the extraction carriage (20) moves in one direction or other in accordance with the direction of rotation of the motor.

Preferably, the coin mechanism incorporates a plurality of pairs of extraction photocells (not shown), to detect whether or not a coin has been effectively extracted. The aforementioned detection is facilitated if, as mentioned above, the coins are extracted towards the interior.

Preferably, in addition to the aforementioned extraction photocells, the coin mechanism may incorporate two pairs of additional cells to determine the position of the extraction carriage (20) with respect to the tubes (39, 40, 43, 44).

According to the aforementioned example, the eight tubes (39, 40, 43, 44) are divided into two rows (F1, F2) and four columns (C1, C2, C3, C4), where the rows (F1, F2) are called first row (F1), disposed in front, and second row (F2), disposed at the rear; likewise, the columns (C1, C2, C3, C4) are called first column (C1), second column (C2), third column (C3) and fourth column (C4), where the first column (C1) corresponds to the first discharge position.

Accordingly, the ejection positions are called: first ejection position, which occupies an outermost position in the direction of width (X), in correspondence with the first end (9); second ejection position, adjacent to the first ejection position; and third ejection position, adjacent to the second ejection position and, therefore, opposed to the first ejection position.

Therefore, the ejectors (41, 42) comprise external ejectors (41) disposed on the external side section (24) destined for extracting coins from the first column (C1), in accordance with a movement of the extraction carriage (20) from the first ejection position to the second ejection position, and from the second column (C2), in accordance with a movement of the extraction carriage (20) from the second ejection position to the third ejection position.

Likewise, the ejectors (41, 42) additionally comprise internal ejectors (42) disposed in the internal side section (25), destined for extracting coins from the fourth column (C4), in accordance with a movement of the extraction carriage (20) from the third ejection position to the second ejection position, and from the third column (C3), in accordance with a movement of the extraction carriage (20) from the second ejection position to the first ejection position.

As mentioned above, the selective raising of any of the movable tubes (40, 43) enables an empty space which allows extraction of coins from other tubes (39, 40, 43, 44) without colliding with the extraction bushings (6). In accordance with the example explained, the movable tubes (40, 43) preferably comprise: first movable tubes (39) corresponding to one of the two central columns (C2, C3), in the example represented, with the second column (C2); and second movable tubes (43) corresponding to the other of the central columns (C2, C3), i.e. with the third column (C3). Likewise, the tubes (39, 40, 43, 44) comprise static tubes (39, 44) corresponding to the outermost columns, i.e. the first and fourth columns (C1, C4), where the static tubes (39, 44) are not movable, i.e. they remain static.

According to an even more preferable example, as explained in detail herebelow, the first movable tubes (40) are raised simultaneously; likewise, the second movable tubes (43) are also raised simultaneously. In order to reduce or annul a movement of the centre of mass of the coins inside the coin storage compartment (3), the second movable tubes (43) shall preferably descend when the first movable tubes (40) are raised, and vice versa. In the example shown, this occurs, as explained below, in coordination with the movement of the classification carriage (17) in the direction of depth (Y).

Figure 6:
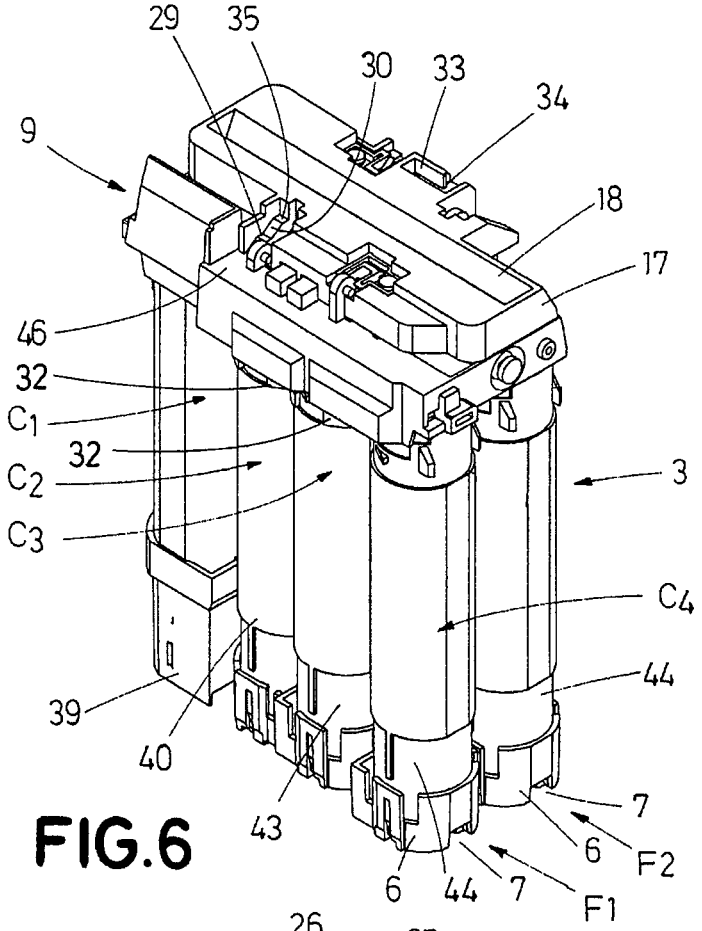
FIG. 6 shows a view of the tube storage compartment.
Figure 7:
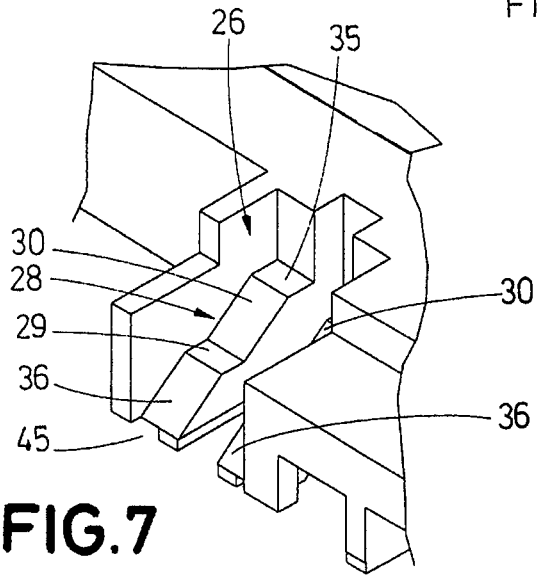
FIG. 7 shows a detailed view of FIG. 6, where ramps that form part of the raising means can be observed.

As shown in FIGS. 4, 6 and 7, the raising means comprise one or several recesses (26) made in the classification carriage (17), each of which is associated with its corresponding movable tube (40, 43); likewise, a ramp (27, 28) longitudinally divides each recess (26), so that each ramp (27, 28) extends from either side of each recess (26). Each ramp (27, 28), in collaboration with an upper surface (45) of the guiding part (46), determines, as explained below, both the positions of the movable tubes (40, 43) in correspondence with the number of depth positions, as well as the path followed by said movable tubes (40, 43) when the classification carriage (17) moves between two consecutive depth positions.

Therefore, in accordance with the example represented (see FIGS. 6 and 7), each ramp (27, 28) comprises in turn: a first horizontal section (29) corresponding to the central depth position; a first inclined section (30) corresponding to the travel distance between the central depth position and the front depth position; a second horizontal section (35) corresponding to the front depth position; and a second inclined section (36) corresponding to the distance between the central depth position and the rear depth position. For the sake of simplicity, in the construction of the ramp (27, 28), the rear depth position may correspond, in accordance with the example represented, to the upper surface (45) of the classification carriage (17).

Additionally, one or several classification rods (31) slideable along the ramps (27, 28) on said ramps (27, 28) by means of the movement of the classification carriage (17) are included, wherein the movable tubes (40, 43) are suspended from the classification rods (31), in order to drag said movable tubes (40, 43) in an alternating vertical movement.

Preferably, the ramps (27, 28) comprise at least one group of ramps (27, 28), where the ramps (27, 28) of each group correspond to all the tubes (39, 40, 43, 44) of the same row (F1, F2) or of the same column (C2, C3); likewise, all the tubes (39, 40, 43, 44) associated with a same group are movable tubes (40, 43); also, the first inclined sections (30) of the ramps (27, 28) of each group are inclined in the same direction.

Preferably, the recesses (26) extend, in an upper view, along a longitudinal direction corresponding to the direction of depth (Y) of the coin mechanism.

In accordance with the example described, as indicated above, the static tubes (39, 44) correspond to the two outermost columns (C1, C4), which are solidarily joined to the frame (38), while the movable tubes (40, 43) correspond to the two central columns (C2, C3). Likewise, in the example represented, the groups are constituted by:

- a first group formed by two first ramps (28) corresponding to one of the two central columns (C2, C3); and
- a second group having two second ramps (27) corresponding to the other of the two central columns (C2, C3).

Preferably, the movable tubes (40, 43), i.e. in the example described, all the tubes of the central columns (C2, C3), comprise, in the upper part thereof, suspension bushings (32) that may be removed to empty or fill said tubes (40, 43) with greater ease, so that the movable tubes (40, 43) are suspended from the classification carriage (17) by means of the suspension bushings (32) in cooperation with the classification rods (31); likewise, the static tubes (39, 44) are preferably disposed leaning on the frame (38).

In the specific case of the example represented in the figures, and in accordance with the foregoing explanation, the movement of the classification carriage (17) in the direction of depth (Y) obliges the classification rods (31) to slide on the ramps (27, 28), so that when the classification carriage (17) moves in one direction, the first movable tubes (40), i.e. those of the second column (C2) are raised, while the second movable tubes (43) of the third column (C3) descend, and vice versa, when the movement carriage (17) moves in the opposite direction. To this end, preferably, the inclined sections (30, 36) of the first ramps (28) are oriented in the opposite direction to the inclined sections (30, 36) of the second ramps (27).

Preferably, the tubes (39, 40, 43, 44) form part of a block, also called "cassette" in the field of the invention, which is insertable in and removable from the frame (38) of the coin mechanism.

In accordance with the example described, the movement of the classification carriage (17) is caused, by means of the second actuation means mentioned earlier, in the manner explained below.

The classification carriage (17) comprises, on the front of the upper part thereof, a movement slot (33) made in the direction of width (X) to house the lower end of the movement rod, said movement slot (33) being limited by transverse walls and longitudinal walls, to allow the exit of the movement rod; likewise, said movement slot (33) has an opening (34) in a first end of a first longitudinal wall.

Further, the second actuation means comprise a rotary cam (not represented in the figures) that rotates around a vertical axis of rotation disposed above the classification carriage (17); likewise, the second actuation means additionally comprise rotation means (not represented) for actuating the rotation of the cam. A movement rod (not shown), comprising a lower end, is solidarily joined to the rotary cam, projecting downwards and eccentrically.

The movement slot (33) is configured to house the lower end of the movement rod, due to which the cam rotation causes movement of the movement rod (because it is eccentric to the axis of the movement cam) against the walls of the movement slot (33), to drag the classification carriage (17) in the direction of depth (Y).

The rotation of this cam is defined to be stopped in four rotation positions: in a first, reference, rotation position, the movement rod (31) occupies a second end, opposite the first end, of the longitudinal walls.

If, as of the first rotation position, the cam rotates a quarter turn in a first direction, in which the movement rod is pressed against the first longitudinal wall, the classification carriage (17) moves towards the rear part. If, on the contrary, from the first rotation position, the cam rotates a quarter turn in a second direction opposite to the first direction, the classification carriage (17) moves towards the front part. Additional rotation in the second direction leaves the movement rod in a second rotation position, for extraction, disposed in opposition to the opening (34).

Preferably, the coin mechanism comprises a movement motor (not shown) and a corresponding gear (not represented), for actuating the rotation of the cam. Even more preferably, a movement card (not shown) having slots (not shown) associated with photocells (not shown) is incorporated to control the rotation position of the cam.

The rotation of the cam to reach the second position, for extraction, can preferably be controlled by means of a PIN code to avoid undue accesses of the tubes (39, 40, 43, 44). Therefore, the invention incorporates a control unit (not represented) that is preferably connected to the rotation means for ordering the positioning of the movement rod in opposition to the opening (34) of the movement slot (33), both if the extraction of the block of tubes (39, 40, 43, 44) is associated with the introduction of a PIN code, as well in the opposite case.

Preferably, the control unit is preferably connected to a record (not represented) to record that an extraction of a block of tubes (39, 40, 43, 44) has been performed. Additionally, the coin mechanism may incorporate optical sensors (not shown) and a battery (not shown) to record said extraction, even in the absence of a power supply, due to the fact that the sensors are housed in an electronic circuit board (not shown) which is fixed to the rear part of the frame (38), emitting light towards prisms (not shown) that are housed in the front part of the block of tubes (39, 40, 43, 44), so that, if the block is removed, the light is no longer reflected onto all the prisms.

Further, the block of tubes may incorporate manipulation photocells (not shown), connected to the control unit, for determining whether or not the cash collection has been manipulated.

The photocells and prisms are disposed in such a manner as to guarantee the fulfillment of their main mission, that of penetrating each of the different tubes (39, 40, 43, 44) with the light beams so that the coins, on entering the corresponding tube (39, 40, 43, 44), cut said beams and inform the control unit that the coin has reached a specific tube (39, 40, 43, 44).

Also, these photocells mark the maximum limit of coins that can be stored in each of the tubes (39, 40, 43, 44), so that, in the event that coins are manually introduced or extracted from the tubes (39, 40, 43, 44) by an operator, the tubes do not become blocked and there are no accounting errors due to the discrepancy between the actual number of coins in the tubes and the amount of coins recorded by the control unit.

The invention claimed is:

1. A coin mechanism for automatic machines, the coin mechanism comprising:

reception means for allowing the access of coins to the coin mechanism;

identification means for determining the acceptability and/or the type and value of the coins that access the coin mechanism;

a coin storage compartment, configured to house and deliver the coins that are selectively destined to be refunded to a user, where the coin storage compartment comprises a plurality of tubes disposed in rows and columns, wherein the tubes of a row define a direction of width of the coin mechanism, as well as the tubes of a column define a direction of depth of the coin mechanism;

extraction means for causing the selective extraction of the coins from the tubes;

wherein the tubes comprise at least one moveable tube; as well as the coin mechanism also comprises raising means configured to selectively raise at least one of the moveable tubes in coordination with the extraction means; and a classifier disposed between the identification means and the coin storage compartment, to transfer the accepted and identified coins to the corresponding tube, where the classifier comprises movement means configured to provide combined movement to the identified coins both in the direction of width and in the direction of depth to leave said coins on the corresponding tube;

wherein the movement means comprises:

a support;

at least one housing, comprised in the support;

a first actuation means for actuating a movement of the support in the direction of width, defining stopping positions for the housings, on the corresponding columns;

a support guide wherealong the support is moveable in the direction of width;

a guiding part linked to the upper part of the tubes;

a classification carriage, moveable with respect to the guiding part in the direction of depth;

a selection slot made in the classification carriage in the direction of width;

a second actuation means for actuating a movement of the classification carriage with respect to the guiding part in the direction of depth, defining depth positions for the selection slot on the corresponding rows;

wherein the housings additionally comprise:

an open upper part to receive the coin; and a lower part, also open and connected to the selection slot of the classification carriage, allowing the lower part of the coin to project partially in order to associate the coin simultaneously with the support and with the classification carriage during the movements of the support and classification carriage; and the guiding part further comprises a delivery slot associated with each tube, so that the stopped position and depth position selectively determine a delivery position for the delivery slot on the corresponding tube.

2. The coin mechanism of claim 1, wherein the first actuation means comprises:

a support motor;

a helicoidal pinion actuable by the support motor;

a first connecting rod connected to engage with the pinion; and a second connecting rod actuable by the first connecting rod, and connected to the support;

to cause the movement of the support in the direction of width.

3. The coin mechanism of claim 2, wherein the second connecting rod is shorter than the first connecting rod.

4. The coin mechanism of claim 1, wherein the second actuation means comprise:

a rotary cam for rotating around a vertical axis of rotation;

a movement rod that projects downwards from the cam, which is rotatable eccentrically together with the cam around the vertical axis and which comprises a lower end; and rotation means for actuating the rotation of the cam;

where the classification carriage additionally comprises a movement slot in the front of the upper part, having a longitudinal direction oriented along the direction of width, to house the lower end of the movement rod, the movement slot being limited by transverse walls and longitudinal walls, and having an opening on a first end of a first longitudinal wall, to allow the exit of the movement rod;

so that the rotation of the cam causes the movement of the movement rod against the walls of the movement slot, in order to drag the classification carriage in the direction of depth.

5. The coin mechanism of claim 4, wherein the tubes are integrated in a block of tubes insertable in and removable from the frame, where the movement slot and movement rod configure a form-fit seal to avoid extraction of the block of tubes, where the block is removable when the movement rod is disposed opposite the opening of the movement slot.

6. The coin mechanism of claim 5, further comprising a control unit for controlling the operation of the coin mechanism, wherein the control unit is connected to the rotation means, to order the positioning of the movement rod opposite the opening of the movement slot.

7. The coin mechanism of claim 6, wherein the control unit is connected to the rotation means, to order the positioning of the movement rod opposite the opening of the movement slot after recognizing a PIN previously introduced by the user.

8. The coin mechanism of claim 6, wherein the control unit is connected to a record for recording the extraction of the block of tubes, and the coin mechanism further comprises a plurality of manipulation photocells, installed on the block of tubes, wherein the control unit is connected to the manipulation photocells, for determining whether or not the cash collection has been manipulated.

9. The coin mechanism of claim 1, wherein the classification carriage is a flat part.

10. The coin mechanism of claim 1, wherein the support comprises two housings.

11. The coin mechanism of claim 1, wherein the first actuating means additionally comprise:

a classifier card having a plurality of pairs of photocells, where each pair comprises:

an emitting photocell to emit a beam corresponding to said pair; and a receiving photocell for receiving the corresponding beam; and a protuberance made in the first connecting rod for cutting the photocell beams;

where the beams correspond to various stopping positions of the support for stopping the support in a predetermined stopping position.

12. The coin mechanism of claim 1, wherein the raising means comprise:

one or several recesses made in the classification carriage, each of which recesses is associated with its corresponding moveable tube;

a ramp that extends longitudinally on either side of each recess, wherein the ramp comprises, in turn:

horizontal sections in correspondence with the depth positions ; and inclined sections that connect the horizontal sections and which are in correspondence with movements between contiguous depth positions; and one or several classification rods, wherein the moveable tubes are suspended from the classification rods and the classification rods are slideable along the ramps by means of the movement of the classification carriage, in order to drag said moveable tubes in an alternating vertical movement.

13. The coin mechanism of claim 12, wherein the classification carriage comprises one or several groups of ramps, where the ramps of each group correspond to all the tubes of a same row or of a same column;

wherein all the tubes associated with a same group are moveable tubes;

as well as the inclined sections of the ramps of all the recesses of a same group have the same direction of inclination.

14. The coin mechanism of claim 13, wherein the tubes consist of two rows and four columns, where the groups consist of:

a first group having two first ramps corresponding to one of the two central columns; and a second group having two second ramps corresponding to the other one of the two central columns.

15. The coin mechanism of claim 14, wherein the inclined sections of the first ramps are inclined in the opposite direction to the inclined sections of the second ramps.

16. The coin mechanism of claim 12, wherein the recesses extend, in an upper view, along a longitudinal direction coincident with the direction of depth of the coin mechanism.

17. The coin mechanism of claim 12, wherein it additionally comprises a removable suspension bushing fixed to the upper part of each moveable tube and connected by the upper part thereof to the corresponding classification rod, so that said moveable tube is suspended by means of the suspension bushings (32) and the classification rod.

18. A coin mechanism for automatic machines, the coin mechanism comprising:

reception means for allowing the access of coins to the coin mechanism;

identification means for determining the acceptability and, where applicable, the type and value of the coins that access the coin mechanism;

a coin storage compartment configured to house and deliver the coins that are selectively destined to be refunded to a user, where the coin storage compartment comprises a plurality of tubes disposed in rows and columns, wherein the tubes of a row define a direction of width of the coin mechanism, as well as the tubes of a column define a direction of depth of the coin mechanism; and extraction means for causing the selective extraction of the coins from the tubes;

wherein the tubes comprise at least one moveable tube; and the coin mechanism also comprises raising means configured to selectively raise at least one of the moveable tubes in coordination with the extraction means; wherein the extraction means comprise:

removable extraction bushings disposed on the lower part of the tubes;

ejection slots disposed on the extraction bushings;

an extraction carriage, disposed under the tubes;

transport means for moving the extraction carriage in the direction of width, defining different extraction positions for said extraction carriage;

guiding means wherealong the extraction carriage is moveable;

at least one ejector, linked to the extraction carriage, and moveable in a vertical direction between a retractable position and a projecting position; and a trigger disposed in each ejector and configured so as to, in a projecting position of the ejector, traverse an ejection slot in coordination with the transport means for extracting a coin simultaneously to a movement of the extraction carriage between two adjacent extraction positions.

19. The coin mechanism of claim 18, wherein the triggers are moveable towards the end of the support that is disposed furthest in the direction of width, so that the coin falls towards the interior.

20. The coin mechanism of claim 18, wherein it additionally comprises extraction photocells for determining whether or not the coins have been extracted.

* * * * *